United States Patent [19]

Landua et al.

[11] Patent Number: 4,665,967

[45] Date of Patent: May 19, 1987

[54] DEVICE FOR THE DUMPING OF SHELLS

[75] Inventors: Werner Landua; Jürgen Müller, both of Mannheim, Fed. Rep. of Germany

[73] Assignee: Adolf Hottinger Giesserei und Maschinenbau GmbH, Fed. Rep. of Germany

[21] Appl. No.: 784,802

[22] Filed: Oct. 4, 1985

[30] Foreign Application Priority Data

Dec. 5, 1985 [DE] Fed. Rep. of Germany ..... 3444342

[51] Int. Cl.[4] ..... B22C 13/08

[52] U.S. Cl. ..... 164/165; 164/166

[58] Field of Search ..... 164/165, 166, 21

[56] References Cited

U.S. PATENT DOCUMENTS

| | | | |
|---|---|---|---|
| 2,798,265 | 7/1957 | Rubovitz et al. | 164/165 |
| 2,905,987 | 9/1959 | Hoekstra et al. | 164/165 |
| 2,962,774 | 12/1960 | Hoekstra et al. | 164/165 |
| 3,508,598 | 4/1970 | York | 164/166 |
| 3,590,905 | 7/1971 | Watts et al. | 164/165 |

FOREIGN PATENT DOCUMENTS

| | | | |
|---|---|---|---|
| 703749 | 7/1956 | United Kingdom | 164/166 |

*Primary Examiner*—Nicholas P. Godici
*Assistant Examiner*—Samuel M. Heinrich
*Attorney, Agent, or Firm*—Toren, McGeady and Goldberg

[57] ABSTRACT

The invention relates to a device for the dumping of shells, having a dumping station and pattern carriers in which the dumping station is combined with several pattern carriers transported in a circle and their pattern device. By means of this device, it is possible to carry out the dumping of shells without non-productive times, that is, without taking into account the hardening times of the shells and without stoppage of the machine, which results in a considerable saving in time.

2 Claims, 7 Drawing Figures

DEVICE FOR THE DUMPING OF SHELLS

The invention relates to a device for dumping of shells.

Shell dump box machines having only one pattern carrier and which work according to the principle of shell dumping by bringing the mold and sand container together by a single rotary movement are known on the market. Likewise, machines are known which carry out the pattern transport, with at least four pattern carriers, by means of a rotary table. According to the state of the art set forth above, it is also known that one dumping station each is allocated to only one pattern carrier each.

The disadvantage of these known devices is that further operations cannot be carried out during the hardening time of the shells. A further disadvantage can be seen in the fact that only one pattern each can be mounted and changing on requirement is very time-consuming.

The object of the invention is to propose a device for dumping of shells which makes possible the dumping of shells without non-productive times, that is, hardening times of the shells, and without stopping the machine.

This object is achieved by combining the dumping station with several pattern carriers transported in a circle and their pattern device.

The device according to the invention enables the application of a completely new method, namely, to combine the dumping principle, which hitherto could only be applied in single-station machines, with one machine having several pattern carrier possibilities. The decisive factor in this method is the operating method during the joining and separating of the sand container (sand box) with the movable machine part equipped with several patterns and pattern carriers.

The very considerable advantage is that the hardening time can be utilized to dump further shells. After one shell has been dumped the dumping operation for a new shell can be started immediately. A further advantage consists in the mounting of patterns in any number within the bounds of the possible and also in the exchange of patterns during the cycle time of the machine. Thus, labor savings are made and only one operator is required at the same position for operating the machine.

The drawings explain an illustrative embodiment of the invention in conjunction with the following description.

FIG. 1 schematically shows the normal position of the device, consisting of a dumping station and a pattern carrier.

FIG. 3 shows the condition after an angle of rotation of 90 degrees, whereas

Figure 1:
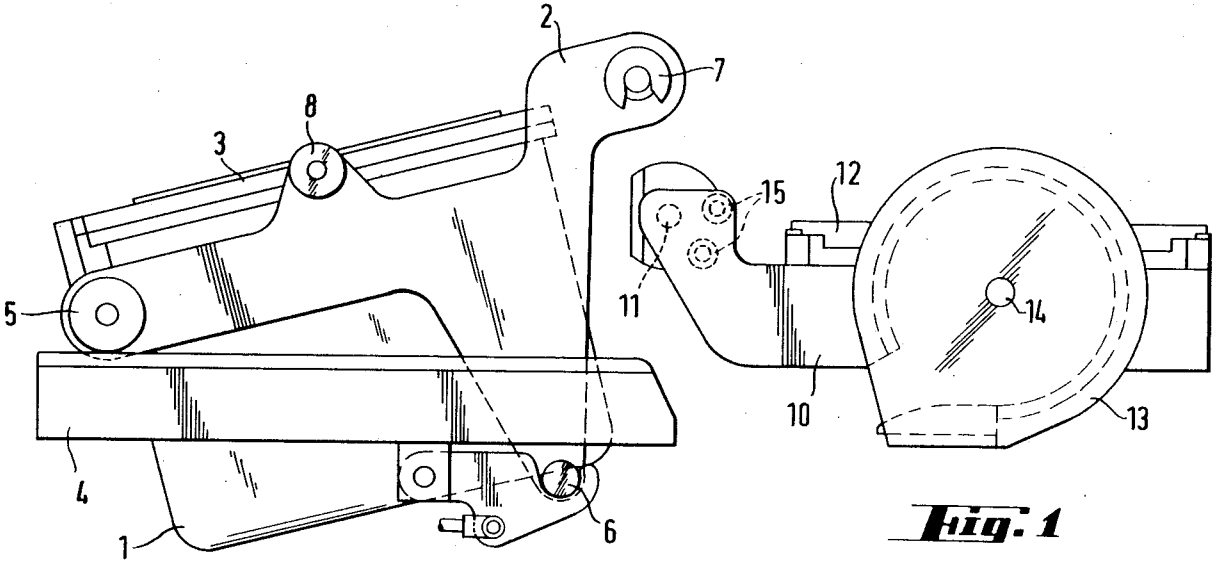
Figure 2:
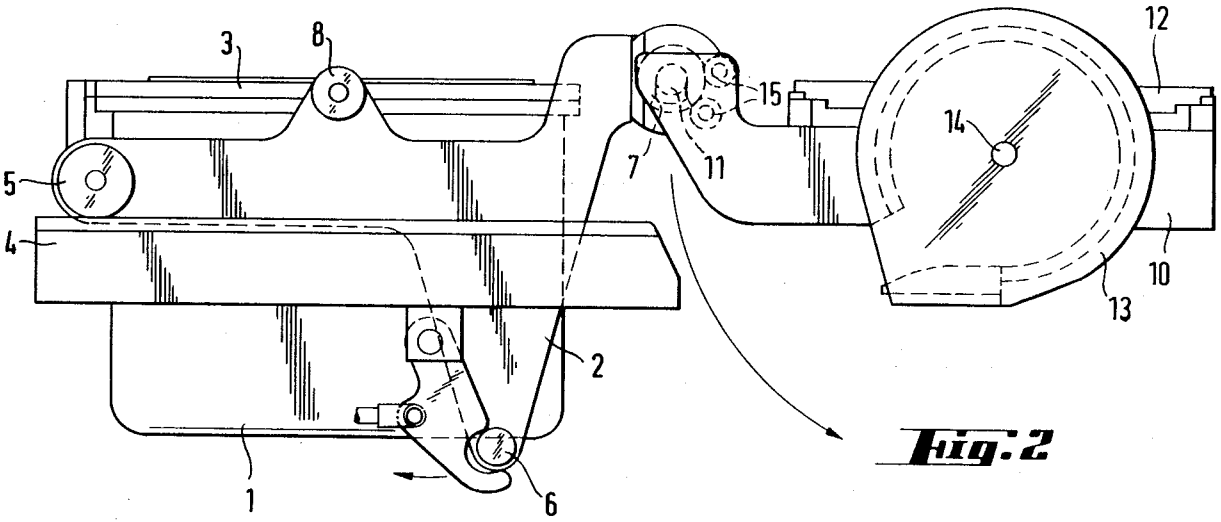
FIG. 2 shows the position at 0 degrees, that is, the dumping station is lowered onto the pattern carrier.
Figure 3:
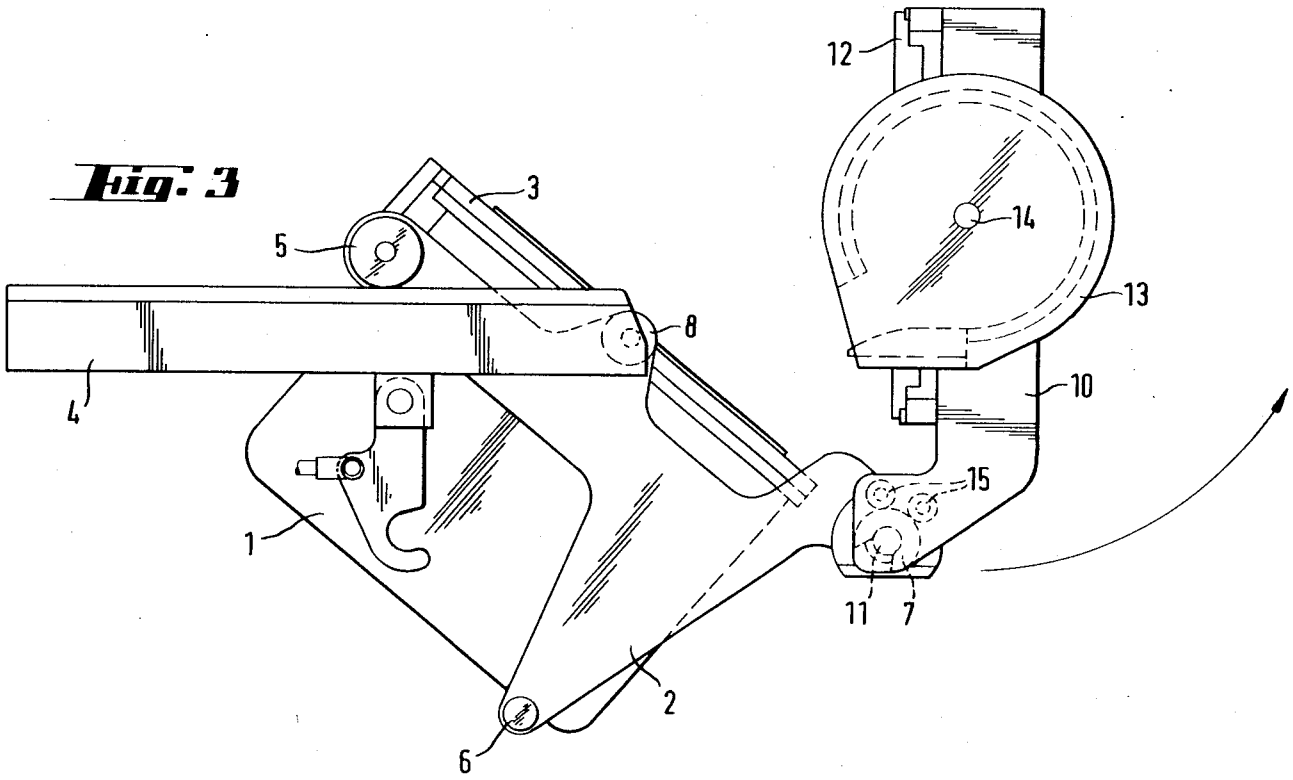
Figure 4:
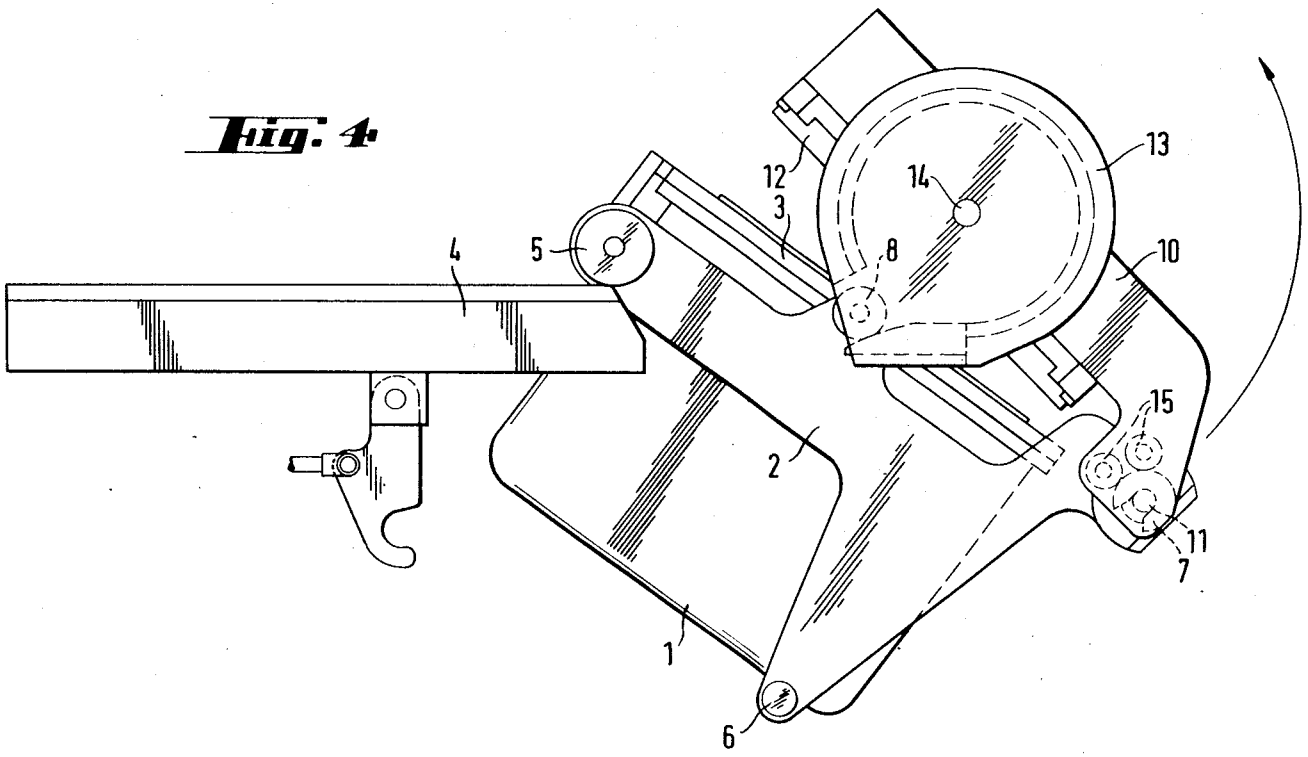
FIG. 4 shows the condition after an angle of rotation of 140 degrees.
Figure 5:
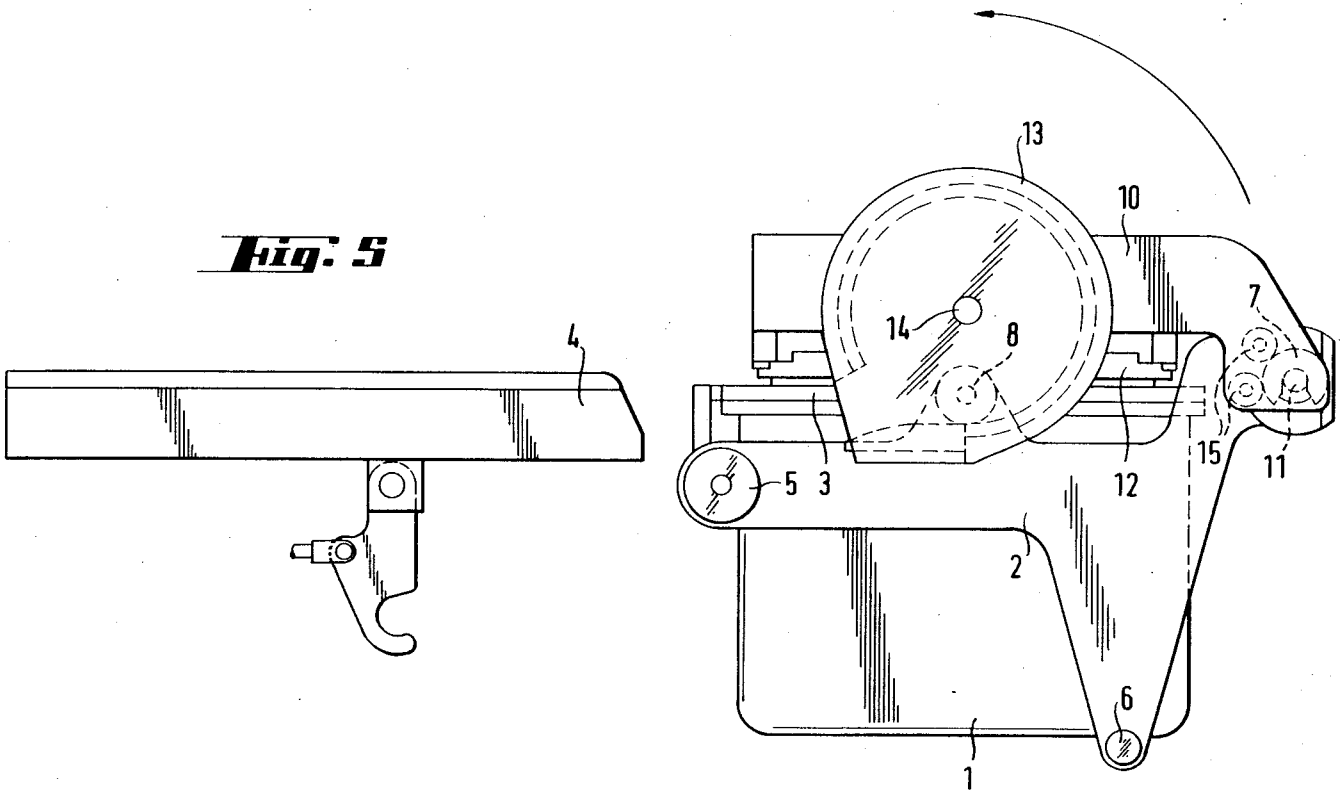
FIG. 5 shows the condition at an angle of rotation of 180 degrees, that is the dump box has now been fully separated from the dumping station and taken over by the pattern carrier and FIG. 6 schematically shows the condition or the position at 360 degrees.
Figure 6:
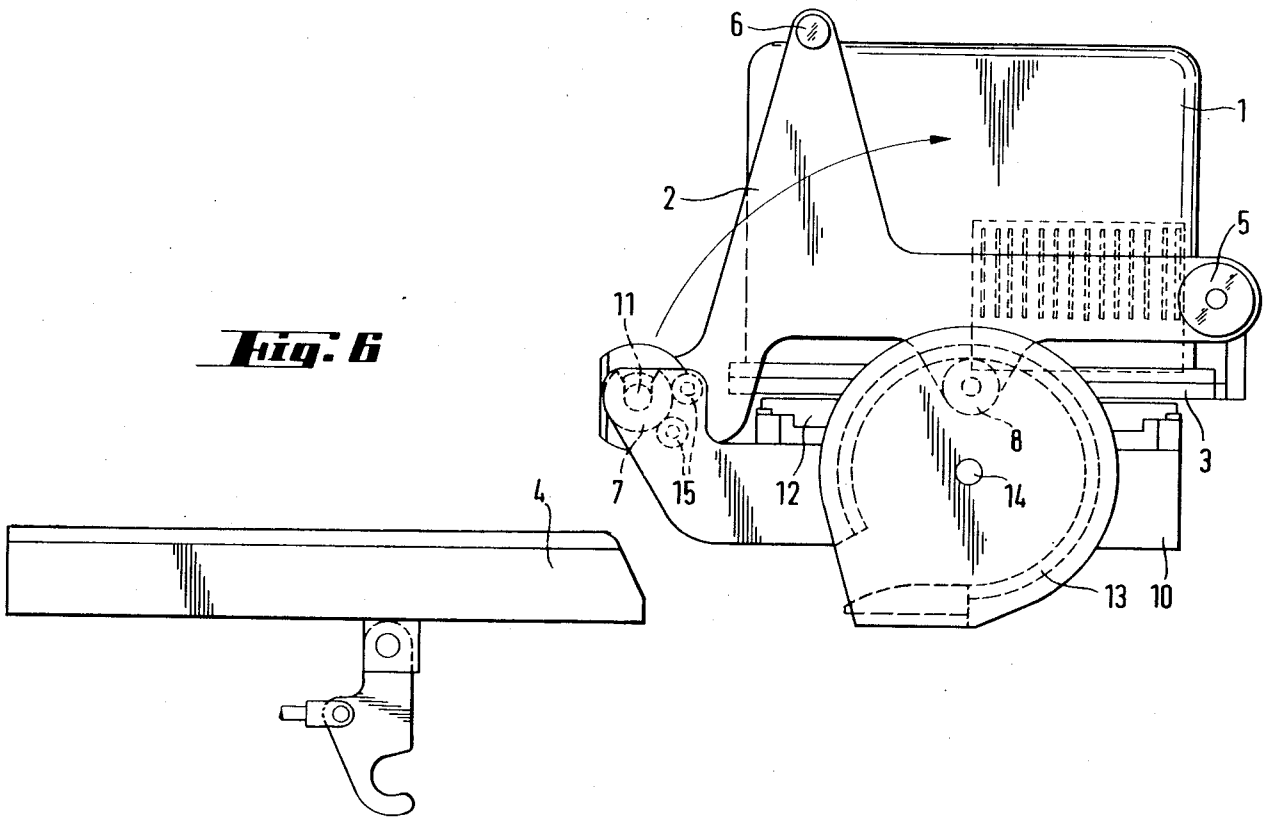
Figure 7:
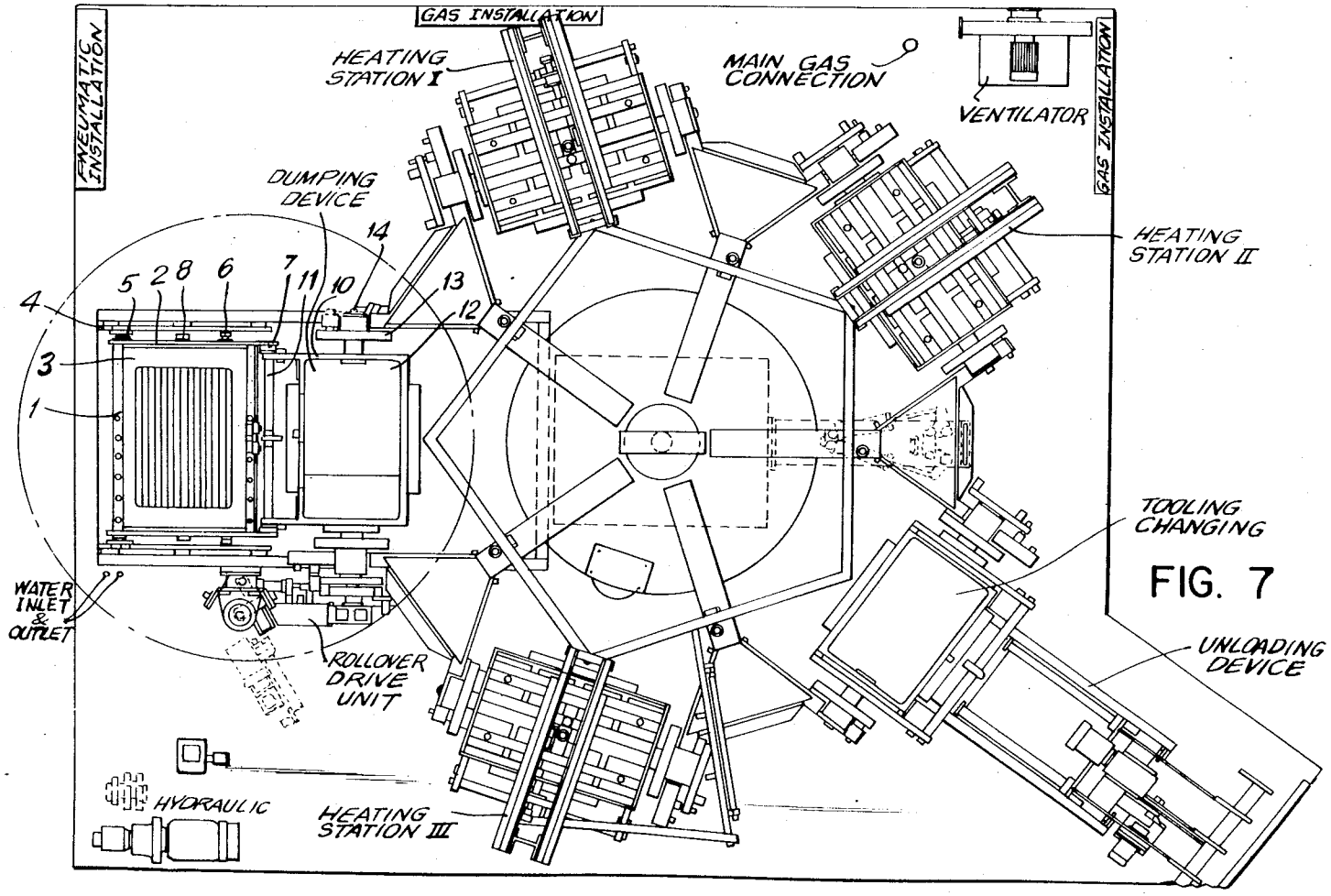
FIG. 7 is a topview of the device according to the invention showing the arrangement of the dumping station in combination with several pattern carriers in a circle and their pattern device.

According to FIG. 1, the fixed-location dumping station consists of the dump box 1 with the retaining frame 2 and the water-cooled dumping frame 3. The dump box 1 runs with the running roller 5 on the running strip 4 and is lifted by the lifting pin 6 and lowered according to FIG. 2 by means of the coupler jaw 7 onto the shaft 11 of the pattern carrier. A transfer roller is designated as 8.

According to FIG. 1 of the drawing, the pattern carrier consists of the pattern carrier frame 10 with the coupling shaft 11, the pattern 12 and the mounting disk 13. The drive shaft is designated 14 and the coupling rollers are designated 15.

The motion sequence according to the schematic representation according to the FIGS. 1 to 6 is as follows:

In the normal position of the dumping station, the dump box 1 is located in a raised position above the pattern carrier which, for connecting to the dump box, is transported up into the exact position and fixed.

The dump box 1 is then lowered by means of the lifting pin 6, so that the coupler jaw 7 comes to rest in the coupling shaft 11.

The mounting frame 10 with the pattern 12 is now turned by the drive shaft 14, with the dump box 1 being firmly connected via the coupler jaw 7 to the coupling shaft 11 and the coupling rollers 15. During this procedure, the rear end of the dump box 1 still sits with its running rollers 5 on the running strips 4 and rolls with increasing rotation towards the end of the running strips 4. At an angle of rotation of about 150°, the running roller 5 completely leaves the running strip 4, after the transfer roller 8 has just previously moved into the mounting disk 13. In this position, the dump box 1 with the retaining frame 2 and the running roller 5 has left its initial position and has been completed with the pattern support into a unit. The rotary motion up to 360° takes place at an adjustable speed and controllable starting and braking moments. After the so-called firing time, the return motion and the uncoupling take place in reverse order.

We claim:

1. A device for the dumping of shells, comprising a dumping station and a plurality of pattern carriers, each pattern carrier including a pattern device, wherein the dumping station is combined with the pattern carriers and their pattern devices which are transported in a circle, the dumping station comprising a dump box, a retaining frame and a dumping frame connected to the dump box, a lifting pin. attached to the retaining frame for lifting the dump box, a coupling jaw connected to the retaining frame on one side of the dump box and a running roller connected to the retaining frame on the other side of the retaining frame, and a running strip on which the running roller travels, the pattern carrier comprising a mounting frame, a coupling shaft attached to the mounting frame on the side facing the dumping station, and a drive shaft attached to the mounting frame for rotating the mounting frame, wherein the dump box is raised by means of the lifting pin and the coupling jaw is lowered onto the coupling shaft, so that, when the drive shaft is rotated, the dump box is moved toward the pattern carrier traveling on the running strip until it is separated from the running strip.

2. The device set forth in claim 1, wherein a transfer roller is attached to the retaining frame of the dumping station and a mounting disk is attached to the pattern carrier, the mounting disk defining a mounting gap, wherein the dump box is combined with the pattern device by feeding the transfer roller into the mounting gap.

* * * * *

UNITED STATES PATENT AND TRADEMARK OFFICE

CERTIFICATE OF CORRECTION

PATENT NO. : 4,665,967

DATED : May 19, 1987

INVENTOR(S) : Werner Landua; Jürgen Müller

It is certified that error appears in the above-identified patent and that said Letters Patent is hereby corrected as shown below:

In the heading of the Patent, it should read:

-- [30] Foreign Application Priority Data

Dec. 5, 1984 [DE] Fed. Rep. of Germany ..... 3444342

Signed and Sealed this

Fifteenth Day of December, 1987

*Attest:*

DONALD J. QUIGG

*Attesting Officer*

*Commissioner of Patents and Trademarks*